US006302210B1

(12) United States Patent
Crow et al.

(10) Patent No.: US 6,302,210 B1
(45) Date of Patent: Oct. 16, 2001

(54) SAFETY VALVE UTILIZING AN ISOLATION VALVE AND METHOD OF USING THE SAME

(75) Inventors: Robert Wesley Crow, Irving; Michael Burl Vinzant, Carrollton; Michael Wade Meaders, Pilot Point, all of TX (US); Gerald L. LeBoeuf, Harvey, LA (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 08/966,554

(22) Filed: Nov. 10, 1997

(51) Int. Cl.[7] ..... E21B 34/10; F16K 31/363

(52) U.S. Cl. ..... 166/324; 166/321

(58) Field of Search ..... 166/319, 321, 166/374, 324, 386; 251/58, 281, 282

(56) References Cited

U.S. PATENT DOCUMENTS

| | | | | |
|---|---|---|---|---|
| 3,696,868 | * | 10/1972 | Taylor, Jr. | 166/375 |
| 3,782,461 | | 1/1974 | Watkins . | |
| 4,149,698 | * | 4/1979 | Deaton | 166/324 X |
| 4,252,197 | | 2/1981 | Pringle . | |
| 4,444,266 | | 4/1984 | Pringle . | |
| 4,495,998 | | 1/1985 | Pringle . | |
| 4,513,944 | * | 4/1985 | Adams, Jr. | 166/319 X |
| 4,598,773 | | 7/1986 | Pringle . | |
| 4,621,695 | | 11/1986 | Pringle . | |
| 4,676,307 | | 6/1987 | Pringle . | |
| 5,906,220 | * | 5/1999 | Thompson | 166/321 X |
| 6,003,605 | * | 12/1999 | Dickson et al. | 166/324 X |

FOREIGN PATENT DOCUMENTS 2 167 791 A 6/1986 (GB) .

* cited by examiner

*Primary Examiner*—David Bagnell
*Assistant Examiner*—Sunil Singh
(74) *Attorney, Agent, or Firm*—William M. Imwalle; David W. Carstens

(57) ABSTRACT

A subsurface safety valve has a tubular valve housing, a valve closure member movable between an open and a closed position, an axially shiftable flow tube for opening the valve closure member. Hydraulic pressure from the control line is used to move a piston, which in turn moves an axially shiftable opening prong through the closure member. A balance line, or second hydraulic line is also used to make the valve well insensitive. An isolation valve is placed in the flow path of the second hydraulic line. The isolation valve prevents gas migration into the balance line. It also provides volume control for the fluid displaced when the piston is moved by pressure from the control line. Further, the valve can be closed by the application of sufficient pressure through the second hydraulic line.

18 Claims, 3 Drawing Sheets

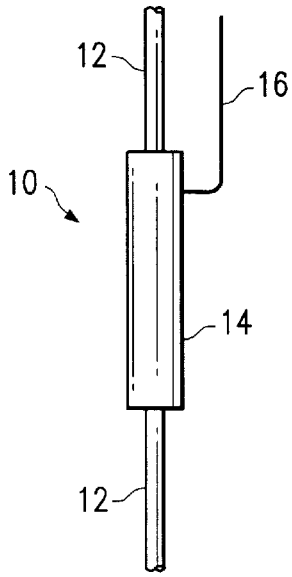
FIG. 1
(PRIOR ART)
FIG. 3
(PRIOR ART)
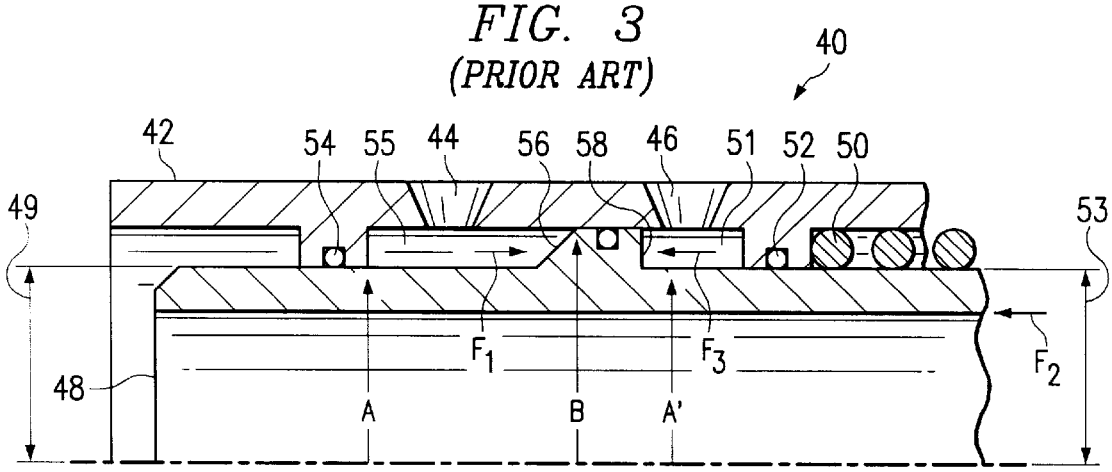
FIG. 4
(PRIOR ART)
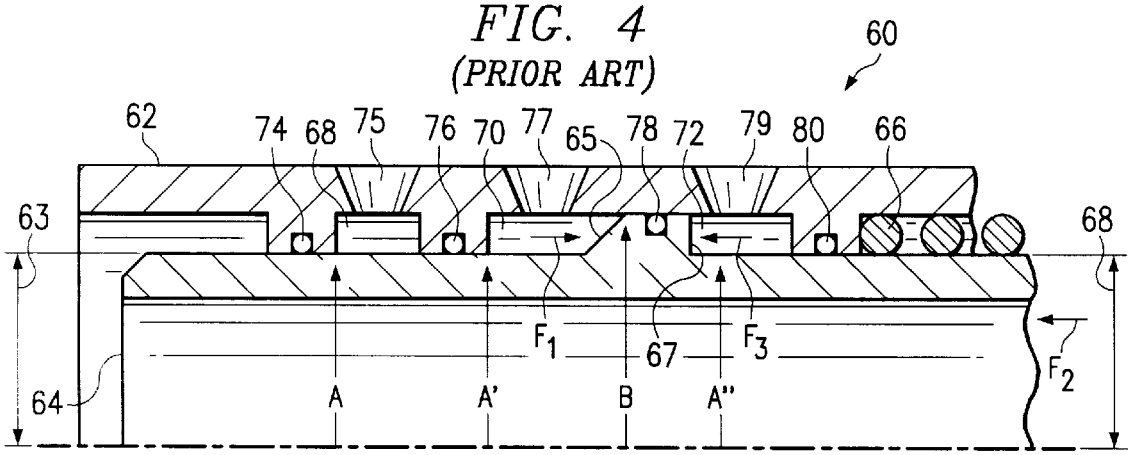

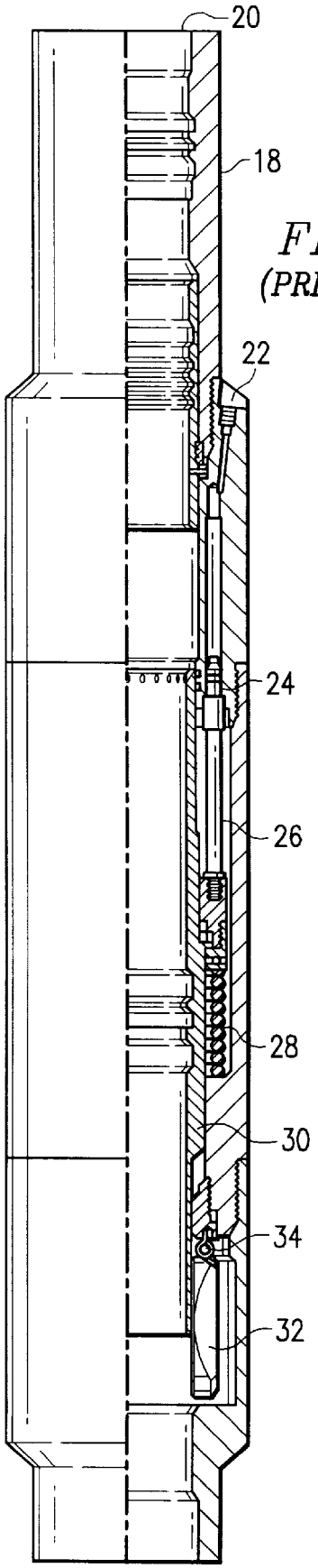
FIG. 2
(PRIOR ART)
FIG. 5
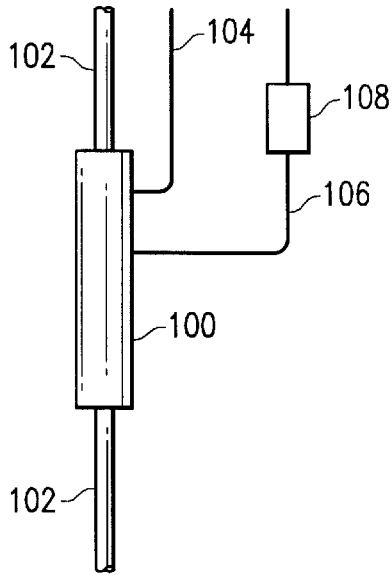
FIG. 6c
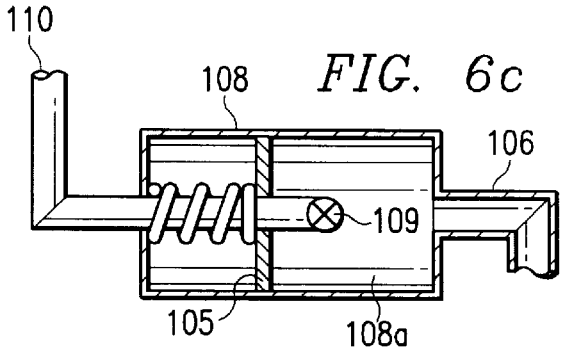

SAFETY VALVE UTILIZING AN ISOLATION VALVE AND METHOD OF USING THE SAME

TECHNICAL FIELD OF THE INVENTION

The present invention relates a subsurface safety valve and, more particularly, to a subsurface safety valve having a tubular housing and an axially shiftable flow tube used to manipulate a valve closure member.

BACKGROUND OF THE INVENTION

Subsurface safety valves (SSSVs) are used within well bores to prevent the uncontrolled escape of well bore fluids, which if not controlled could directly lead to a catastrophic well blowout. Certain styles of safety valves are called flapper type valves because the valve closure member is in the form of a circular disc or in the form of a curved disc. These flappers can be opened by the application of hydraulic pressure to a piston and cylinder assembly to move an opening prong against the flapper. The opening prong is biased by a helical spring in a direction to allow the flapper to close in the event that hydraulic fluid pressure is reduced or lost.

FIGS. 1 and 2 illustrate a standard safety valve configuration 10 wherein a safety valve 14 is interposed in a tubing string 12. A control line 16 is used to open the valve. The valve 14 includes a tubular valve housing 18 with an axial passage 20. When hydraulic pressure is applied through port 22, the pressure forces a piston 24 to engage an axially shiftable opening prong 30. As the pressure forces the piston downward, the opening prong engages the closure member 32 and pushes the member into an open position. A spring 28 opposes the motion of the piston so that when the hydraulic pressure is released, the piston and opening prong are returned to a first position. The weight of the hydraulic fluid produces a "head" force against the piston, and thus is a factor in sizing the spring 28. In general, the pressure required to close the valve 14 is given by:

$$\text{Pressure}_{closing}=\text{Force}_{spring}/\text{Area}_{piston}$$

Setting subsurface safety valves deeper is typically just a matter of ensuring sufficient closing pressure to offset the hydrostatic pressure acting to cause the valve to stay open. Increasing closing pressure is accomplished by increasing the $\text{Force}_{spring}$ or decreasing $\text{Area}_{piston}$ terms.

As the valve closing pressure increases, so does the valve opening pressure. The surface capacity to provide operating pressure is a combination of the pressure needed to open the valve and the internal well pressure:

$$\text{Pressure}_{surface}=\text{Pressure}_{opening}+\text{Pressure}_{well}$$

However, the available surface operating pressure can be limited by the umbilical line used to deliver the hydraulic pressure. It is not uncommon for that limit to be approximately 10,000 psi. Thus, if the surface pressure is fixed and the well pressure increases with depth, the opening pressure decreases with depth.

For this reason, designs which operate independent of well pressure are required. Two well known designs are the dome charges safety valves and balance lines safety valves. A balance line valve 40 having a piston 48 in a housing 42 is illustrated in FIG. 3. Two hydraulic chambers are pressurized on opposite sides of the piston 48. A control line is coupled to a first port 44 while the balance line is coupled to a second port 46. Each hydraulic line is filled with the same type of fluid. Hydrostatic pressure from the well above and below the piston is equal. Thus, there is no downward force on the spring as a result of the hydrostatic pressure. The valve is operated by pressurizing the upper chamber 55 using the control line connected to the first port 44. This increases the downward force F1, displacing fluid from the lower chamber 51 and compressing the spring 50 to open the valve. Well pressure only has access to the upper seal 54.

Well pressure acts upwards on seal 52 and downwards on seal 54. Therefore, the radius 49 of the upper end of the piston 48 is equal to the radius 53 of the lower end, and pressure has no upward or downward resulting force on the piston as long as the seals 52, 54 remain intact. Control line pressure acts downward on surface area 56 while balance line pressure acts upward on surface area 58. Thus, the hydrostatic pressures on opposite sides of the piston 48 are equalized. If seal 52 fails, well pressure enters the balance pressure chamber 57, acting on surface area 58, and increasing F3. If the well pressure is great, it may be impossible to supply sufficient surface pressure to port 44 to force the opening prong downward. Thus, the safety valve fails to a closed position. If seal 54 fails, well pressure would enter the control chamber 55 and act on surface area 56 increasing F1. Without applying control line pressure, the F1 would be greater than F2+F3. This imbalance causes the valve to fail in an open position. The valve can be closed by pressuring up the balance line port 46 so that F3+F2 is greater that the well assisted F1. This is only possible if sufficient balance line pressure can be applied. Another failure mode occurs when gas in the well fluid migrates into the balance line, reducing the hydrostatic pressure applied by the balance line, i.e. reducing F3.

Another style of balance line safety valve is illustrated in FIG. 4. The valve 60 has a piston 64 captured within a housing 62 and three hydraulic chambers 68, 70, and 72, two above and one below the valve piston. Two hydraulic lines are run to the surface. Well pressure acts on seals 74, 80. Since the radius 63 of the upper end and the radius 68 of the lower end of the piston are the same, well pressure has no influence on the pressure required to displace the piston. One of the two hydraulic lines is a control line and is connected to port 77. The other hydraulic line is a balance line and is connected to the upper port 75 and the lower port 79. Control line and balance line hydrostatic pressures act on identical piston surface areas 65, 67 B-A' and B-A", so there is no net upward or downward force. If seal 74 leaks, well pressure accesses the balance line system. This pressure acts on surface area 67, boosting force F3, which with spring force F2 will overcome F1, to close the valve. If seal 76 leaks, communication between the control and balance lines will be established. F1 will always equal F3. Thus, F2 will be the only active force causing the valve to close. If seal 78 leaks, it has the same effect as seal 76 leaking. If seal 80 leaks, tubing pressure accesses the balance line system. This pressure acts to increase F3, overcoming F1 and closing the valve. Thus, if sufficient control line pressure is available and tubing pressure is relatively low, it may be possible to open the valve if upper seal 74 and/or lower seal 80 leak. Control line force F1 must be greater than the tubing assisted balance force F3 plus the spring force F2. In all modes of failure for this valve, the valve fails to a closed position.

A dome charge safety valve uses a captured gas charge. The gas charge provides a heavy spring force to achieve an increased closing pressure. However, dome charge designs are complex and require specialized manufacturing and personnel. This increases the cost and decreases the reliability of the design because numerous seals are required. Also, industry standards favor metal-to-metal (MTM) sealing systems. Gas charges require the use of elastomeric seals.

A need exists for a safety valve suitable for subsea applications and which is well pressure insensitive. Thus, it should incorporate the benefits of a balance line SSSV while overcoming the difficulties associated with gas migration into the balance line. Such a valve should also utilize MTM sealing systems for increased reliability. Finally, the improved valve should allow for the application of hydraulic pressure to close the valve in the event of a valve failure in an open position.

SUMMARY OF THE INVENTION

The present invention relates to an improved safety valve that can be used in deep set applications by utilizing a simple pressure isolated chamber in combination with an isolation valve. The isolation could be part of the valve or a separate item. The isolation valve addresses the concerns typically associated with balance line concepts while also eliminating the need to contain a gas charge with elastomeric seals.

The isolation valve 108 is a key element of the solution. The isolation valve provides for volume exchange within the pressure isolated chamber 108*a* during opening and closing. This further ensures that the necessary volume is provided even if some fluid exchange occurs between the first set of well isolation seals. The isolation valve 108 also provides for pressure shut-off 109 of the secondary line, while also preventing gas migration into the secondary line. It further provides for transfer of pressure from secondary line for closing valve for remedial cycling of the safety valve.

The isolation valve also allows for the use of conventional SSSV technology whereas seal failure of the pressure isolation chamber does not impact the valve reliability after well pressure depletes. It is a lower cost solution with higher reliability. In combination with the secondary pressure line, the isolation seal differential is minimized by applying secondary line pressure. Finally, this design solution provides for common equipment between conventional completions and subsea completions.

BRIEF DESCRIPTION OF THE DRAWINGS

For a more complete understanding of the present invention, and for further details and advantages thereof, reference is now made to the following Detailed Description taken in conjunction with the accompanying drawings, in which:

FIGS. 1 and 2 schematically illustrate a prior art safety valve having a single control line;

FIG. 3 illustrates a prior art balance line safety valve having a balance line;

FIG. 4 illustrates an improved prior art balance line safety valve;

FIG. 5 illustrates an embodiment of the present invention safety valve utilizing an isolation valve on the second control line.

FIG. 6*c* is a schematic illustration of the isolation valve.

DETAILED DESCRIPTION OF THE DRAWINGS

Figures 6A, 6B:
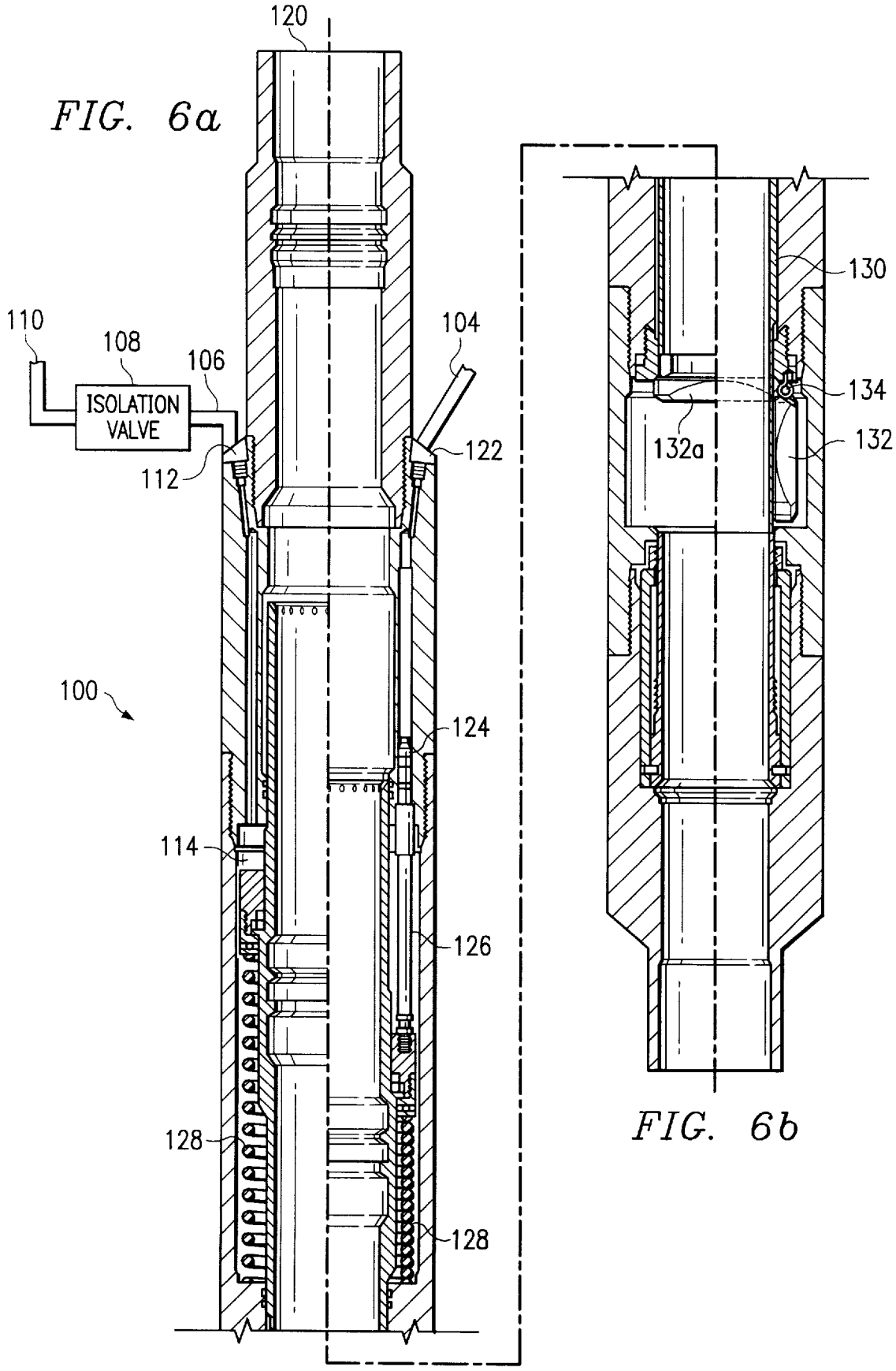
FIGS. 6*a* and 6*b* are sectional views across the length of the present safety valve.

A safety valve 100 embodying the present invention is illustrated in FIGS. 5, 6*a*, and 6*b*. The valve 100 is placed in the flow path of tubing 102. A control line 104 is coupled to a first input port 122. When hydraulic pressure is applied through port 122, the pressure forces a piston 124 to engage an axially shiftable opening prong 130. As the pressure forces the piston 124 downward, the opening prong engages the closure member 132 and pushes the member into an open position. A spring 128 opposes the motion of the piston 124 so that when the hydraulic pressure is released, the piston 124 and opening prong 130 are returned to a closed position 132*a*. The closure member is biased to a closed position by a torsional spring 134.

The weight of the hydraulic fluid produces a "head" force against the piston. A second hydraulic line 106 can be coupled to a second port 112 which allows it to supply hydraulic pressure to an annular chamber 114. The pressure in the annular chamber 114 can be used to counteract the hydraulic head from the control line 104, thereby making it easier for the spring 128 to lift the opening prong 130 to close the valve. Further, if the piston 124 or the opening prong 130 were to mechanically jam due to debris or otherwise, a lifting force could be applied through the second line 106.

The isolation valve 108 contains a variable volume chamber 108*a*. When the piston 124 is displaced downward by pressure applied through the control line 104, a volume of fluid beneath the piston 124, in annular chamber 114, is necessarily displaced. The displaced volume can flow back into the second line 106 and into the isolation chamber 108*a* which expands to accommodate the displaced volume. The isolation chamber 108*a* can be a housing with a movable piston 105 for one wall. As displaced fluid enters the isolation chamber 108*a*, the piston 105 wall will move in response.

In the embodiment discussed above, a second hydraulic line is coupled, through 106 an isolation valve 108 to second port 112. In an alternative embodiment, the second hydraulic line 106 is open at 110 to the well annulus. By pressurizing the annulus, the same functionality is achieved as with a second hydraulic line. In an alternate embodiment, the second hydraulic line is closed at 110. In this case, while additional closing pressure cannot be applied, the isolation valve 108 will allow for volume control of the fluid displaced by the piston 124 when pressure is applied through the control line 104.

Although preferred embodiments of the present invention have been described in the foregoing Detailed Description and illustrated in the accompanying drawings, it will be understood that the invention is not limited to the embodiments disclosed, but is capable of numerous rearrangements, modifications, and substitutions of steps without departing from the spirit of the invention. Accordingly, the present invention is intended to encompass such rearrangements, modifications, and substitutions of steps as fall within the scope of the appended claims.

We claim:

1. A safety valve for use in a well bore having an annulus, said valve comprising:

(a) a tubular valve housing;

(b) a valve closure member captured in said housing and movable between an open and a closed position;

(c) an axially shiftable opening prong captured in said housing for opening the valve closure member;

(d) a control line for supplying a hydraulic pressure to move the opening prong against the closure member;

(e) a balance line coupled to said tubular housing; and (f) an isolation valve coupled to said balance line wherein the isolation valve isolates said balance line from a g as migration from said safety valve.

2. The safety valve of claim 1 further comprises a piston downwardly responsive to said hydraulic pressure from said control line, wherein said piston is displacable into an annular chamber, and wherein said piston is coupled to the opening prong.

3. The safety valve of claim 2, wherein said annular chamber is in fluid communication with said isolation valve.

4. The safety valve of claim 1 further comprises a piston upwardly responsive to a hydraulic pressure from said balance line.

5. The safety valve of claim 1 wherein said balance line is coupled to a surface pressure source.

6. The safety valve of claim 1 wherein said balance line is coupled to the annulus.

7. The safety valve of claim 6 wherein said annulus is pressurized.

8. A method of operating a safety valve placed in the flow path of a string of well tubing within a well annulus, said safety valve having a control line supplying a first hydraulic pressure to an axially shiftable opening prong, said method comprising the steps of:

(a) supplying a second source of hydraulic pressure through a balance line to an annular chamber within said safety valve; and (b) isolating said balance line from a gas migration from said safety valve with an isolation valve comprised of an expandable volume chamber capable of receiving fluid displaced from within said safety valve.

9. The method of claim 8 further comprises:

(c) applying a closing pressure to said safety valve through said balance line.

10. The method of claim 9 wherein said balance line pressure exceeds said control line pressure.

11. The method of claim 8, wherein step (a) further comprises coupling said balance line to a surface pressure source.

12. The method of claim 8 wherein step (a) further comprises coupling said balance line to said well annulus.

13. A safety valve for use in a well bore, said valve comprising:

(a) a tubular valve housing;

(b) a valve closure member captured in said housing and movable between an open and a closed position;

(c) an axially shiftable opening prong captured in said housing for opening the valve closure member;

(d) a control line for supplying a hydraulic pressure to move the opening prong against the closure member;

(e) a balance line coupled to said tubular housing wherein said balance line is coupled to an annulus, and (f) an isolation valve coupled to said balance line.

14. The safety valve of claim 13 wherein said isolation valve comprises a variable volume chamber.

15. The safety valve of claim 13 further comprises a piston downwardly responsive to said hydraulic pressure from said control line, wherein said piston is displacable into an annular chamber, and wherein said piston is coupled to the opening prong.

16. The safety valve of claim 15 wherein said annular chamber is in fluid communication with said isolation valve.

17. The safety valve of claim 13 further comprises a piston upwardly responsive to a hydraulic pressure from said balance line.

18. The safety valve of claim 13 wherein said isolation valve isolates the balance line from a migration of gas into the balance line.

* * * * *